US008777052B2

(12) United States Patent
De Jesus

(10) Patent No.: US 8,777,052 B2
(45) Date of Patent: Jul. 15, 2014

(54) CONTAINER AND CONTAINER CLOSURE

(75) Inventor: Luis Manuel Correia De Jesus, Cork (IE)

(73) Assignee: Chandela Limited, Dublin (IE)

( * ) Notice: Subject to any disclaimer, the term of this patent is extended or adjusted under 35 U.S.C. 154(b) by 730 days.

(21) Appl. No.: 12/520,649

(22) PCT Filed: Dec. 20, 2007

(86) PCT No.: PCT/EP2007/064376

§ 371 (c)(1),
(2), (4) Date: Jan. 15, 2010

(87) PCT Pub. No.: WO2008/074876

PCT Pub. Date: Jun. 26, 2008

(65) Prior Publication Data

US 2010/0108705 A1 May 6, 2010

(30) Foreign Application Priority Data

Dec. 21, 2006 (IE) ..... S2006/0937
Feb. 28, 2007 (GB) ..... 0703869.8

(51) Int. Cl.
*B65D 39/00* (2006.01)
*B65D 17/52* (2006.01)
*B65D 43/04* (2006.01)

(52) U.S. Cl.
USPC ..... 220/789; 220/285; 220/802

(58) Field of Classification Search
USPC ..... 220/789, 319, 798–802, 805, 284, 220/254.7, 656, 657, 659, 260, 305, 275, 220/787–794, 782, 783, 784
See application file for complete search history.

(56) References Cited

U.S. PATENT DOCUMENTS

| | | | | | |
|---|---|---|---|---|---|
| 3,566,946 | A | * | 3/1971 | Mac Donald | 220/783 |
| 4,043,482 | A | | 8/1977 | Brown | |
| 4,335,827 | A | | 6/1982 | Knize et al. | |
| 4,423,822 | A | * | 1/1984 | Powalowski | 215/365 |
| 4,458,825 | A | * | 7/1984 | Holota | 220/782 |
| 4,474,305 | A | * | 10/1984 | Marco | 220/787 |
| 4,676,392 | A | | 6/1987 | Giggard et al. | |
| 4,998,622 | A | * | 3/1991 | Drack | 206/519 |
| 5,125,530 | A | * | 6/1992 | Straub | 220/783 |
| 5,303,839 | A | * | 4/1994 | Blumenschein | 222/572 |
| 5,307,949 | A | * | 5/1994 | Von Holdt, Jr. | 220/276 |

(Continued)

FOREIGN PATENT DOCUMENTS

| | | |
|---|---|---|
| EP | 0278581 A2 | 8/1988 |
| GB | 1582416 | 1/1981 |

(Continued)

*Primary Examiner* — Bryon Gehman
*Assistant Examiner* — Shawn M Braden
(74) *Attorney, Agent, or Firm* — Hoffmann & Baron, LLP

(57) ABSTRACT

The present invention relates to container and a closure for mounting on the container, the container of the type comprising a container body having a base and a side wall with a top edge defining a container opening opposite the base. The container further comprises a rim and a locking rib which projects from a free end of the rim, and the closure comprises a top wall and a skirt having a closure flange which projects from a free end of the closure wall for snap engagement under the locking rib when the closure is inserted into the container opening. The present invention ensures that a strong seal is maintained between the closure and the container so that the container can be opened and closed frequently without leakages between the container and the closure.

21 Claims, 17 Drawing Sheets

(56) References Cited

U.S. PATENT DOCUMENTS

| | | | | |
|---|---|---|---|---|
| 5,437,386 | A * | 8/1995 | Von Holdt | 220/783 |
| 5,842,593 | A | 12/1998 | Von Holdt | |
| 6,851,569 | B2 * | 2/2005 | Conti et al. | 220/297 |
| 7,124,910 | B2 * | 10/2006 | Nordland | 220/839 |

FOREIGN PATENT DOCUMENTS

| | | | |
|---|---|---|---|
| GB | 2198718 | A | 6/1988 |
| GB | 2204322 | A | 11/1988 |
| JP | 9207957 | | 5/1996 |
| JP | 10278953 | | 4/1997 |

* cited by examiner

CONTAINER AND CONTAINER CLOSURE

This application is the U.S. National Phase of, and Applicant claims priority from, International Application Number PCT/EP2007/064376 filed 20 Dec. 2007, Irish Patent Application No. S2006/0937 filed 21 Dec. 2006, and United Kingdom Patent Application No. GB0703869.8 filed 28 Feb. 2007, each of which are incorporated herein by reference.

INTRODUCTION

The present invention relates to container and a closure for mounting on the container. Although reference throughout this specification will describe the present invention in relation to its use as a container for paint, this should in no way be seen as limiting.

Paint containers are known to consist of three parts, the container itself, a closure, and a rim ultrasonically welded to the container for reception of the closure and sealing of the container. Although paint containers have historically been manufactured using various metals and metal alloys it is becoming increasingly common for such containers to be manufactured from plastics. However, the requirement to ultrasonically weld a rim to the container remains, and this presents numerous problems in terms of increased manufacturing costs and the performance of the container. For example, it is known for internal 'pockets' to form between the rim and the container and these 'pockets' are prone to trap paint. Furthermore, the presence of a rim, which generally extends across the opening of the container, not only reduces the size of a container opening but will also often cause paint to become trapped when, for example, the container is being emptied. This also presents a disposal problem as the trapped paint must first be removed and the containers washed clean so that they can be recycled. Moreover, once a paint container has been opened it is extremely difficult to return the closure to the container and achieve a good seal. Thus leakages between the container and the closure are common.

Further significant problems relating to obtaining efficient access to the container contents whilst still achieving a good seal when the closure is returned to the container also arise in prior art container arrangements. Presently users must insert the end of a tool, such as a screwdriver, into a slot formed between the container and the closure and then apply a pressure to the tool to lift the closure from the container in order to open the container. However, there are numerous disadvantages associated with this approach. Such problems include the wear that is caused to the container and the closure resulting from the levering engagement between the tool, the closure and the container. Such wearing will typically cause damage to the closure and container, which will in turn reduce the ability for a good seal to form when the closure is placed on the container, thus causing leakages from the container. Use of such an opening method will also require that operatives have ready access to tools, such as screwdrivers, to facilitate opening, which is disadvantageous.

It is a therefore an object of the present invention to provide a container and a closure for the container which goes at least some way toward overcoming the above problems and for which will provide the public and/or industry with a useful alternative.

It is acknowledged that the term 'comprise' may, under varying jurisdictions be provided with either an exclusive or inclusive meaning. For the purpose of this specification, and unless otherwise noted explicitly, the term comprise shall have an inclusive meaning—i.e. that it may be taken to mean an inclusion of not only the listed components it directly references, but also other non-specified components. Accordingly, the term 'comprise' is to be attributed with as broader interpretation as possible within any given jurisdiction and this rationale should also be used when the terms 'comprised' and/or 'comprising' are used.

Further aspects of the present invention will become apparent form the ensuing description which is given by way of example only.

STATEMENTS OF INVENTION

According to the invention, there is provided a container and a closure for the container, the container of the type comprising a container body having a base and a side wall with a top edge defining a container opening opposite the base, characterised in that

- the container further comprises a rim spaced apart from the side wall by a container flange which extends outwardly of the container body, and a locking rib which projects from a free end of the rim, and
- the closure comprises a top wall and a skirt which extends downwardly from a peripheral edge of the top wall, the skirt comprising a closure wall and biasing means for sealing the closure wall against an interior wall surface of the container side wall, and a closure flange which projects from a free end of the closure wall for snap engagement under the locking rib when the closure is inserted into the container opening.

The present invention ensures that a strong seal is maintained between the closure and the container. This ensures that the container can be opened and closed frequently without leakages between the container and the closure. Use of a biasing means enables the closure to be placed on the container and 'snap-locked' on the container by 'hand snapping', whilst eliminating paint splash from the container.

In another embodiment of the invention, at least one sealing rib is provided on an interior wall surface of the container side wall for engagement with a rib receiving channel formed in a facing surface of the closure wall. Such a rib and channel will together ensure the closure remains secure on the container under a variety of conditions, such as when the container is being transported, or is dropped. It will also ensure that the closure is correctly aligned and centred on the container.

In another embodiment of the invention, the container is an integrally formed injection moulded plastics container. The provision of a one-part container eliminates the formation of internal 'pockets' in the container which are prone to trap paint and make them unsuitable for use in tinting. Moreover, a one-part container provides smooth internal surfaces which provide for easy pouring and no paint will collect under the rim when paint is poured from the container. An injection moulded plastics container formed in accordance with the present invention will also be easier and less expensive to manufacture than a two-part container. It will also be easier to dispose of such a container since it will not be necessary to wash away paint that has collected under the rim. It is also therefore more environmentally friendly than a two-part container.

In another embodiment of the invention, the rim and container flange extend around an exterior wall surface of the container to define, with a portion of an exterior wall surface of the container side wall, a substantially U-shaped channel at the top edge of the container side wall.

The provision of such a U-shaped channel provides a reservoir to catch any paint which may run over the top edge of the container. This is of particular benefit when, for example, paint is being poured out of the container, or when paint brushes are 'dabbed' on the top edge of the container, as is common practice. Without the U-shaped channel it will be appreciated that such paint would normally run down the exterior wall surface of the container side wall.

Preferably, the rim projects above of the top edge of the container so that the locking rib projects proud of the top edge of the container.

Preferably, the vertical distance between the locking rib and the top edge of the container is greater than the thickness of the free end of the closure flange which locks under the locking rib.

In another embodiment of the invention, when the closure is inserted onto the container the rim pivots so that the closure flange engages against and slides under the locking rib to enable the closure flange to seat on or slightly above the top edge of the container side wall and under the locking rib. This feature facilitates the 'snap-lock' closing mechanism of the present invention.

In another embodiment of the invention, the closure is plug-like for insertion into the container opening. Such a feature ensures that the closure can be efficiently placed on and also removed from the container.

Optionally, the closure flange comprises a plurality of through slots. This feature will enable operatives to insert the end of a tool, such as a screwdriver, into the closure to facilitate its removal from the container.

Preferably, a tamper evident seal in the form of a thin plastic membrane extends across each slot. The provision of such a tamper evident seal ensures that it is not possible to remove the closure from the container without first breaking the seal, which can effectively alert users, on visible inspection of the closure, to the fact that the container has been previously opened. Use of a thin plastic membrane also avoids the need for the use of tear tabs, pull tabs or unwrapping tabs, the use of which is more expensive in terms of manufacturing costs, and also requires the tabs to be disposed of once they have been removed from the closure, which is both time consuming and wasteful.

In another embodiment of the invention, a portion of the top wall of the closure and the locking rib are substantially diametrically level when the closure is mounted on the container. This feature will prevent any instances of over pressing the closure and damaging the sealing mechanisms when fitting the closure to the container.

In another embodiment of the invention, the rim and container flange do not extend fully around the container side wall to define a cut-away portion in the rim.

In another embodiment of the invention, a substantially hook shaped external seating flange projects from a free end of the top edge of the container side wall in the region of the cut-away portion.

Preferably, an actuating lever having a locking projection formed on an inner surface thereof depends from a free end of the closure flange.

In another embodiment of the invention, the locking projection engages under a terminal end of the hook shaped seating flange to releasably lock the closure to the container.

In another embodiment of the invention, an operative removes the closure from the container by applying a pulling force to the actuating lever to disengage the locking projection from underneath the terminal end of the seating flange.

In another embodiment of the invention, a removable tamper evident strip is mounted to the container substantially adjacent the hook shaped seating flange and proximal to a free end of the actuating lever.

In another embodiment of the invention, the presence of the tamper evident strip prevents an operative actuating the lever by preventing access to the lever.

In another embodiment of the invention, the container is substantially square shaped.

In another embodiment of the invention, the rim and container flange do not extend fully around the container side wall to define a receiving notch for a closure actuating button formed on the closure wall.

Preferably, a tamper evident strip extends across the closure actuating button.

In another embodiment of the invention, a locking flange projects from the closure wall on each side of the closure actuating button.

Preferably, each locking flange engages under the locking rib on the container rim when the closure is mounted on the container.

Preferably, applying a pressing force to the closure actuating button pushes the locking flanges away from under the locking rib and enables the closure to be removed from the container.

DETAILED DESCRIPTION OF THE INVENTION

The invention will be more clearly understood from the following description of some embodiments thereof, given by way of example only, with reference to the accompanying drawings, in which.

Figure 1:
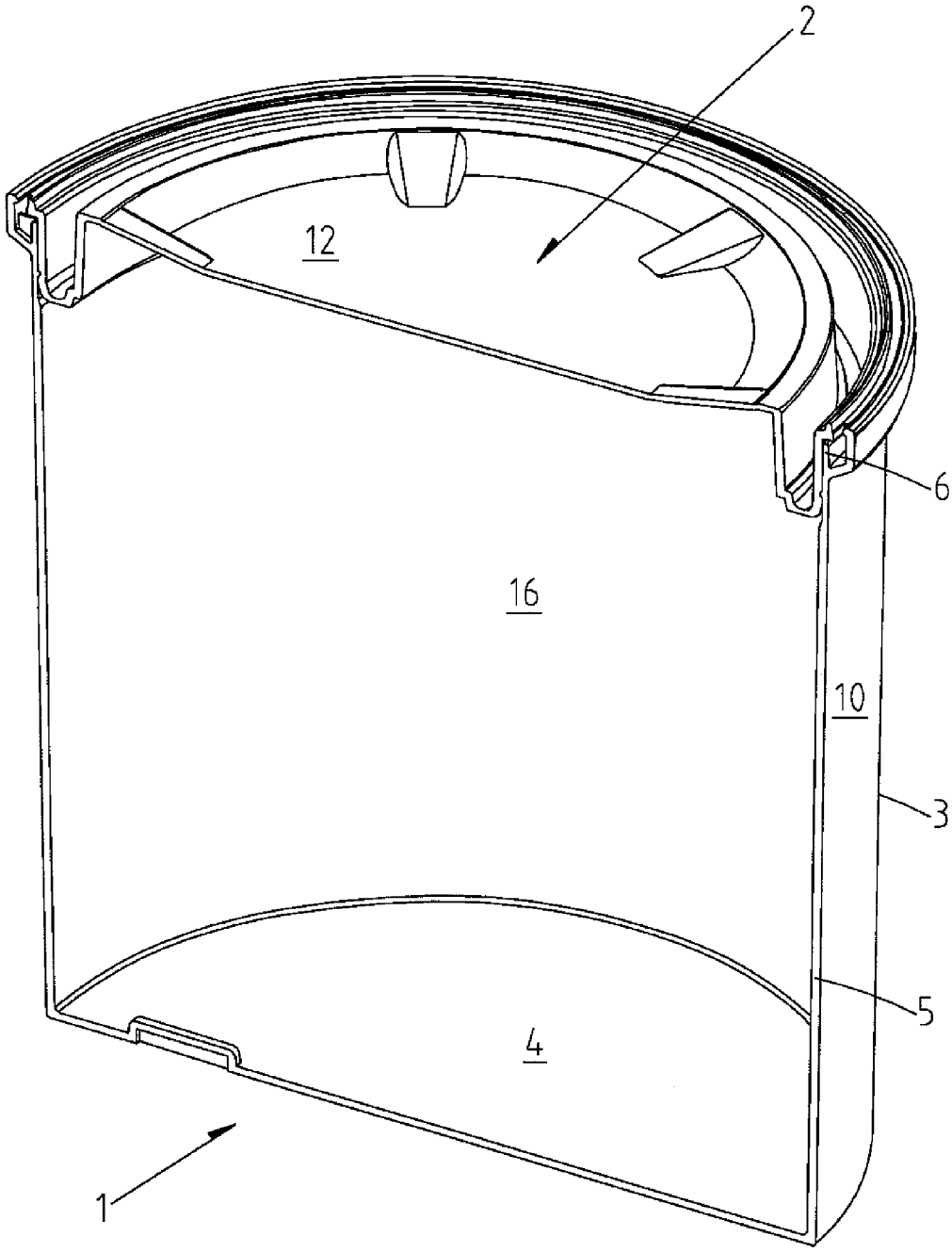
FIG. 1 is a sectional perspective view of a container and a closure mounted on the container according to the invention.
Figure 2:
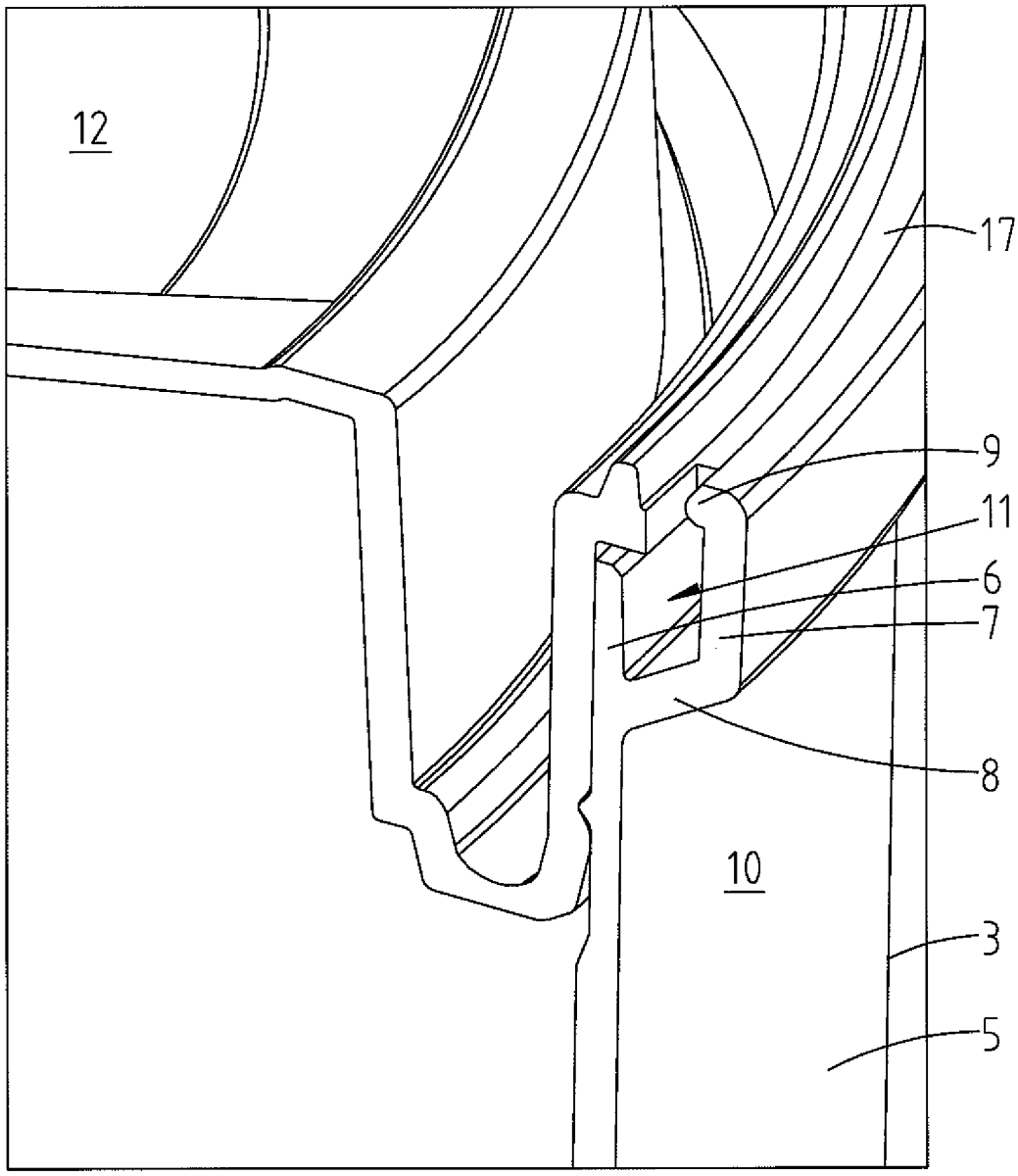
FIG. 2 is a detailed sectional perspective view showing a portion of the container and closure shown in FIG. 1.
Figure 3:
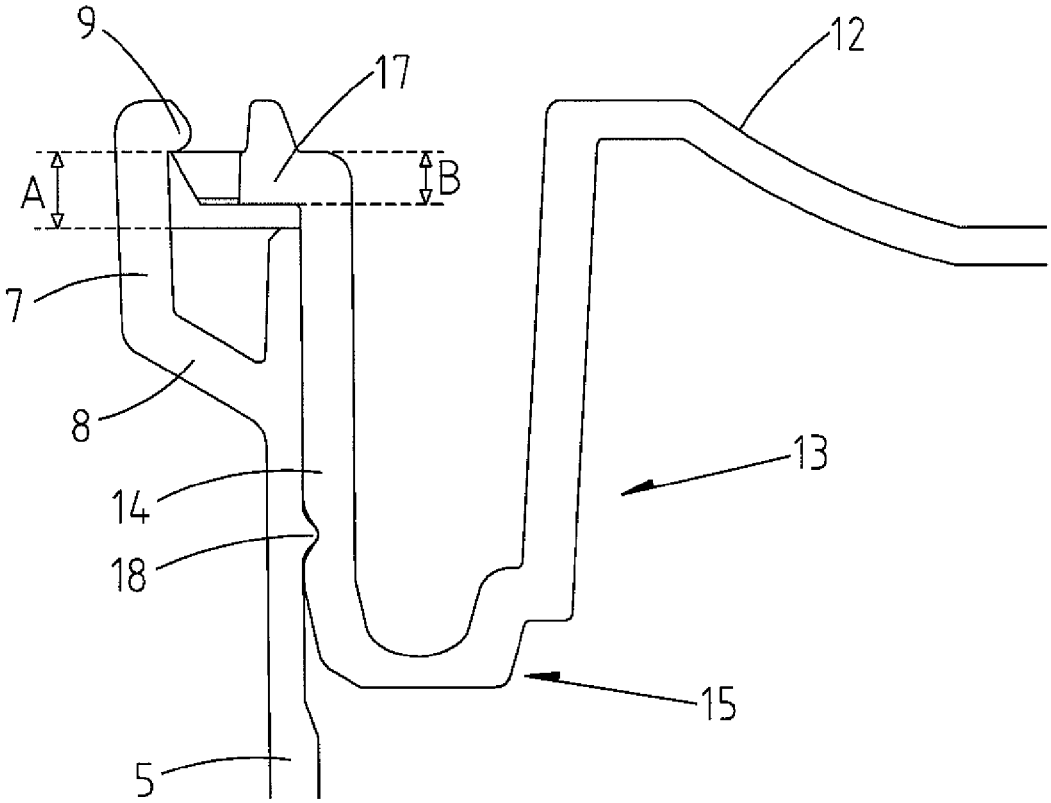
FIG. 3 is a sectional view showing the portion of the container and closure shown in FIG. 2.
Figure 4:
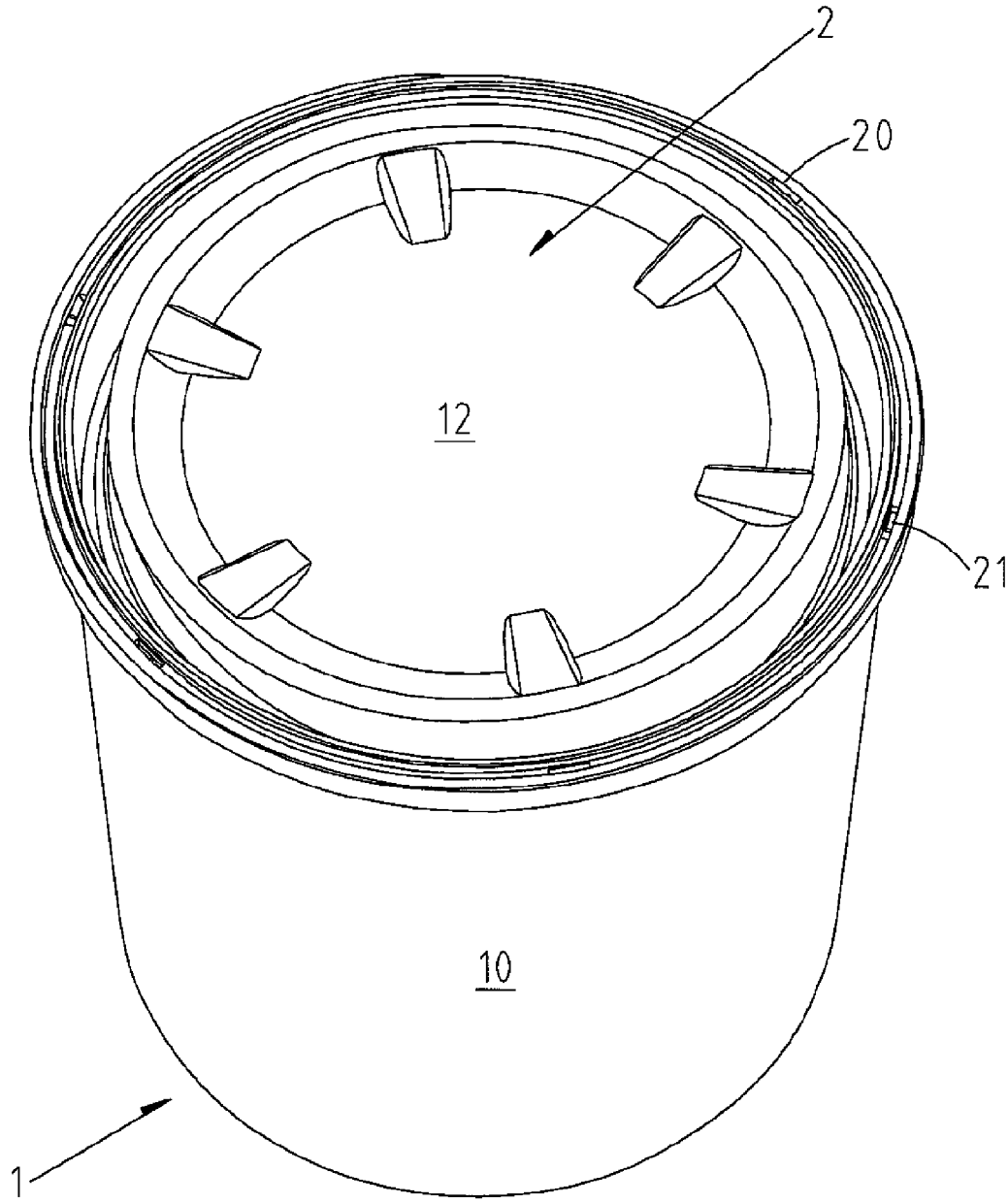
FIG. 4 is a perspective view of the container and closure shown in FIG. 1.
Figure 5:
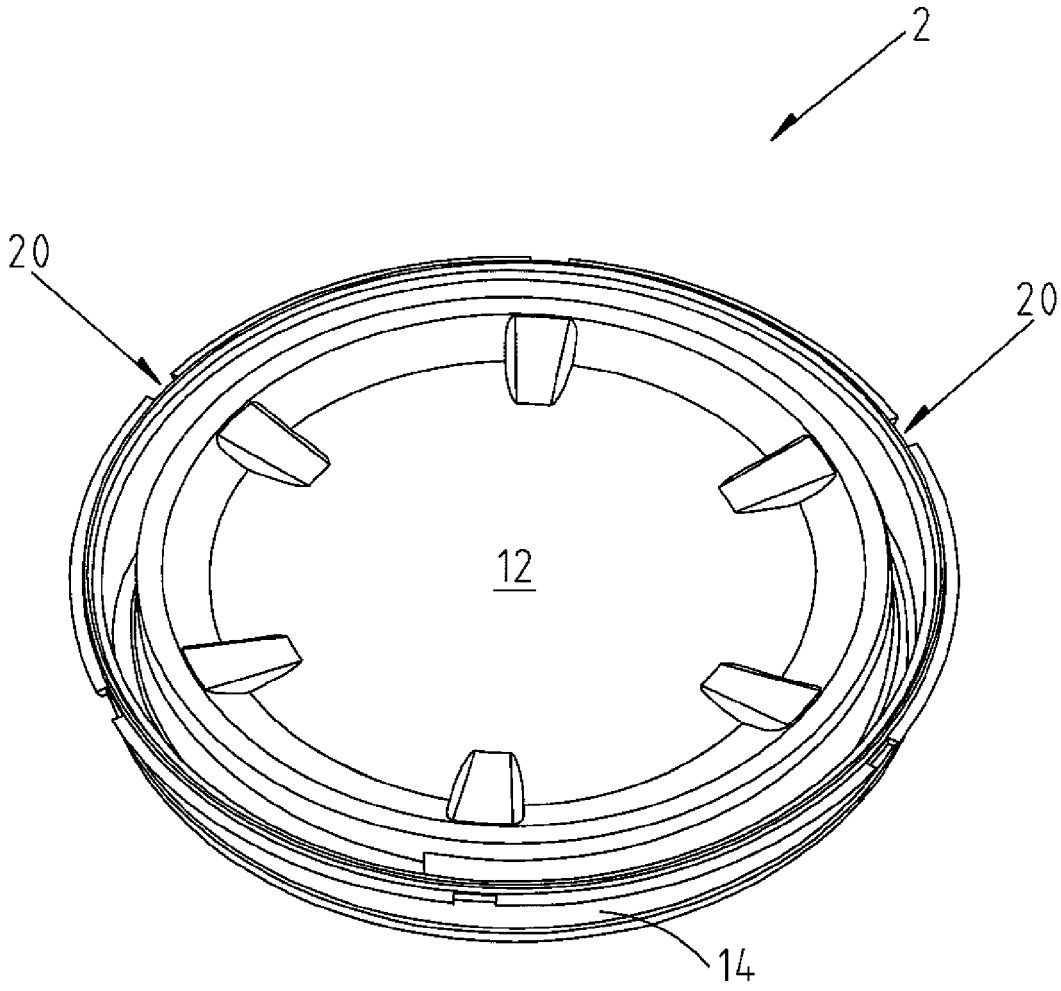
FIG. 5 is a perspective view of the closure shown in FIG. 4.
Figure 6:
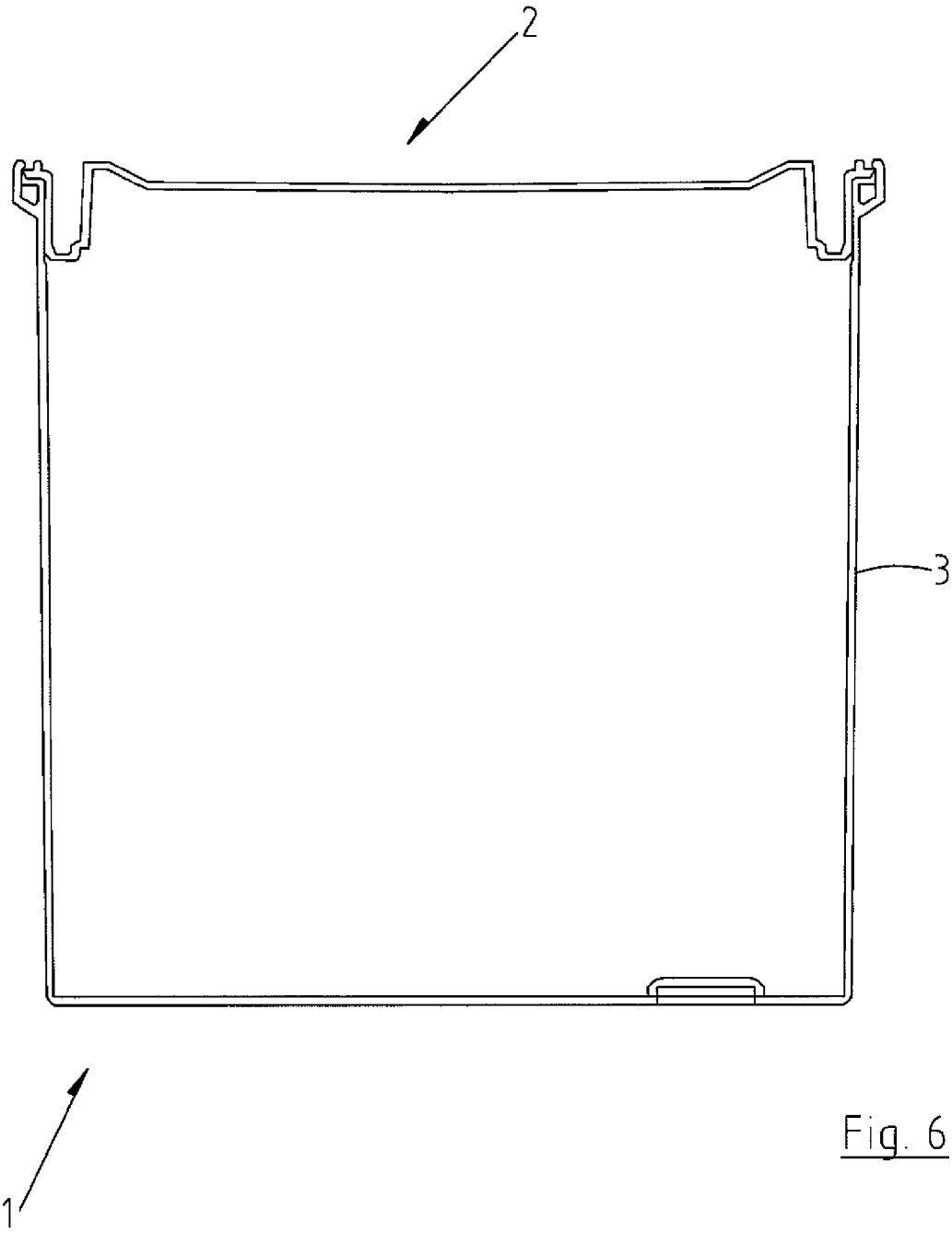
FIG. 6 is a sectional view of the container and closure shown in FIG. 1.

Referring to the drawings, and initially to FIGS. 1 to 7, there is shown a container, indicated generally by the reference numeral 1, and a closure, indicated generally by the reference numeral 2, for mounting on the container 1. The container 1 comprises a container body 3 having a base 4 and a side wall 5 with a top edge 6 defining a container opening opposite the base 4. The container 1 also comprises a rim 7 spaced apart from the side wall 5 by a container flange 8 which extends outwardly of the container body 3. Also shown is a locking rib 9 which projects from a free end of the rim 7. In the instance shown, the rim 7 and the container flange 8 extend around an exterior wall surface 10 of the container 1 to define, with a portion of the exterior wall surface 10 of the container side wall 5, a substantially U-shaped channel, indicated generally by the reference numeral 11, near the top edge 6 of the container side wall 5. The rim 7 also extends axially above of the top edge 6 of the container 1 so that the locking rib 9 projects proud of the top edge 6 and towards the container body 3. The container 1 is an integrally formed injection moulded plastic container.

Figure 7:
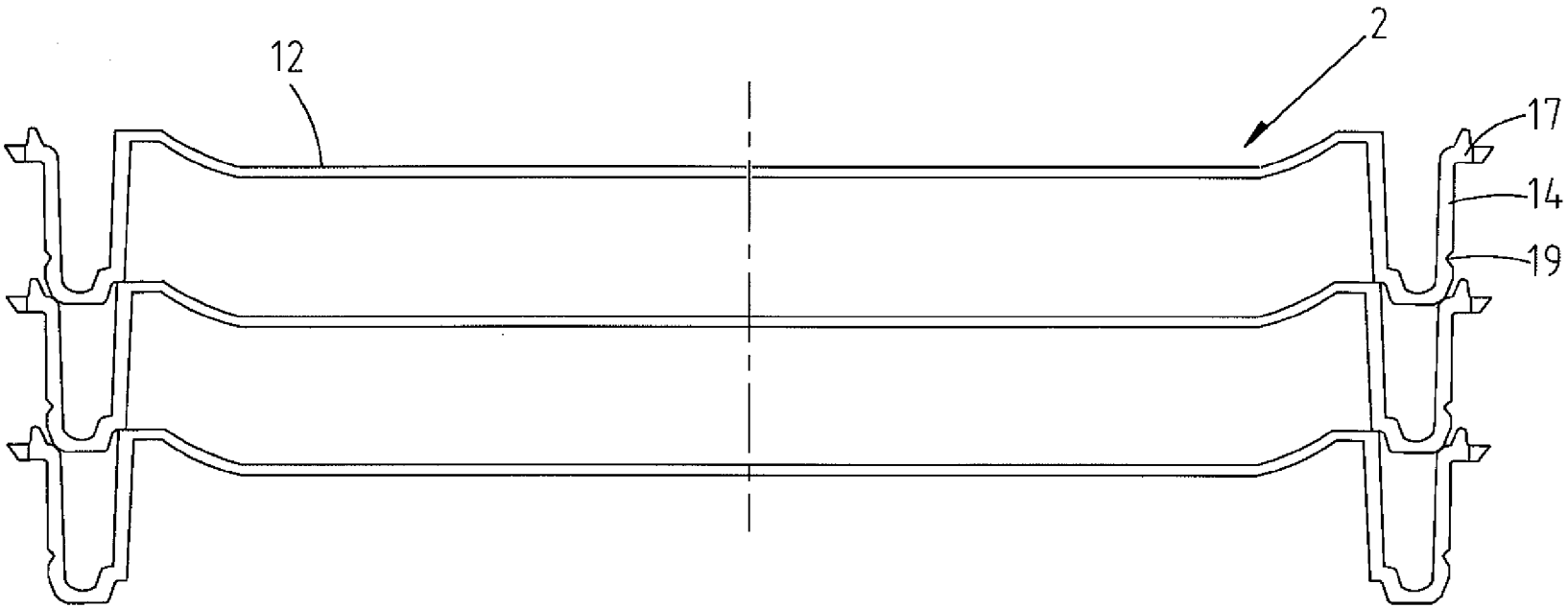
FIG. 7 is a sectional view of a plurality of the closures shown in FIG. 5 stacked.
Figure 8:
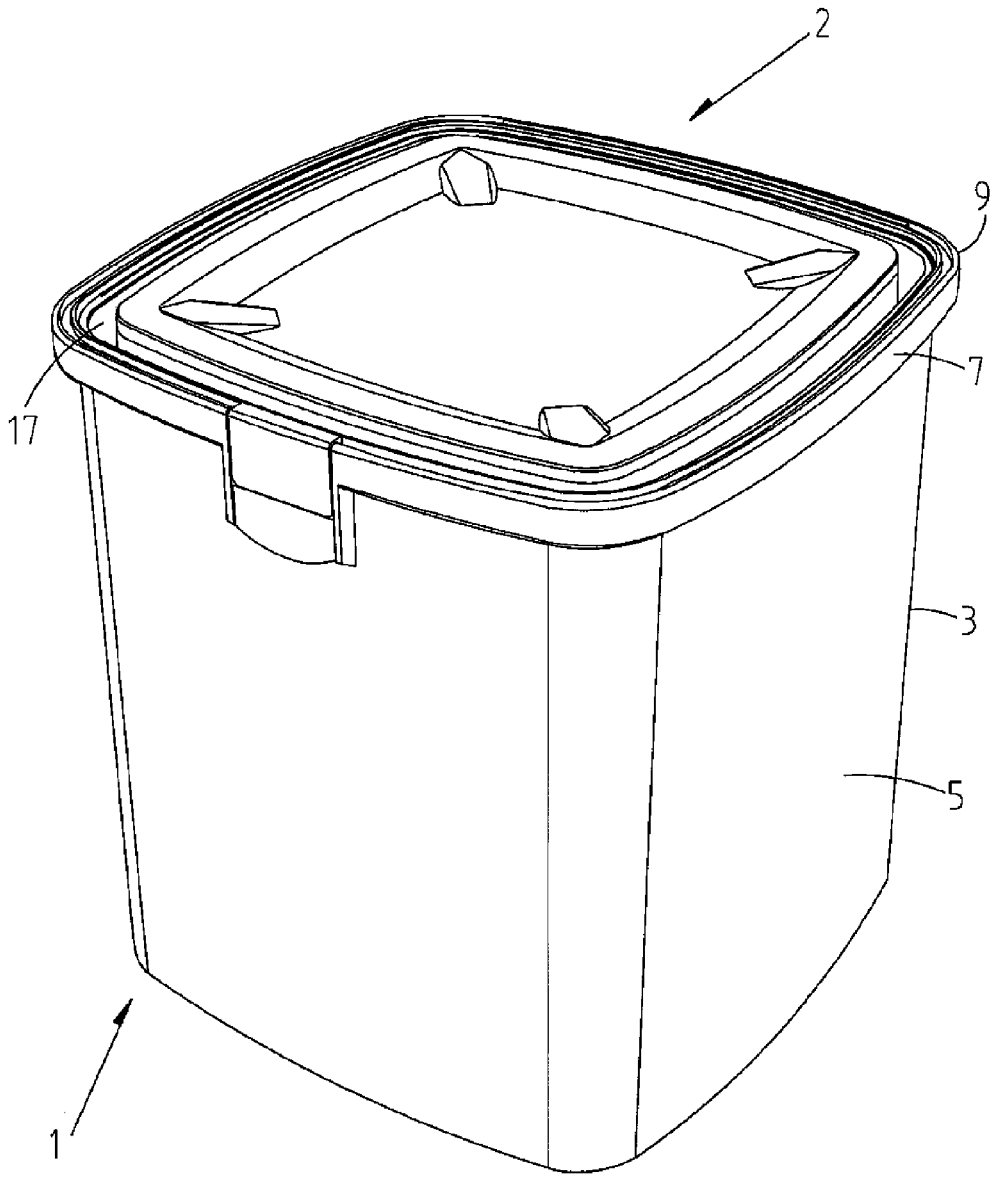
FIG. 8 is a perspective view of a container and a closure mounted on the container incorporating an actuating lever according to a further embodiment of the present invention.
Figure 9:
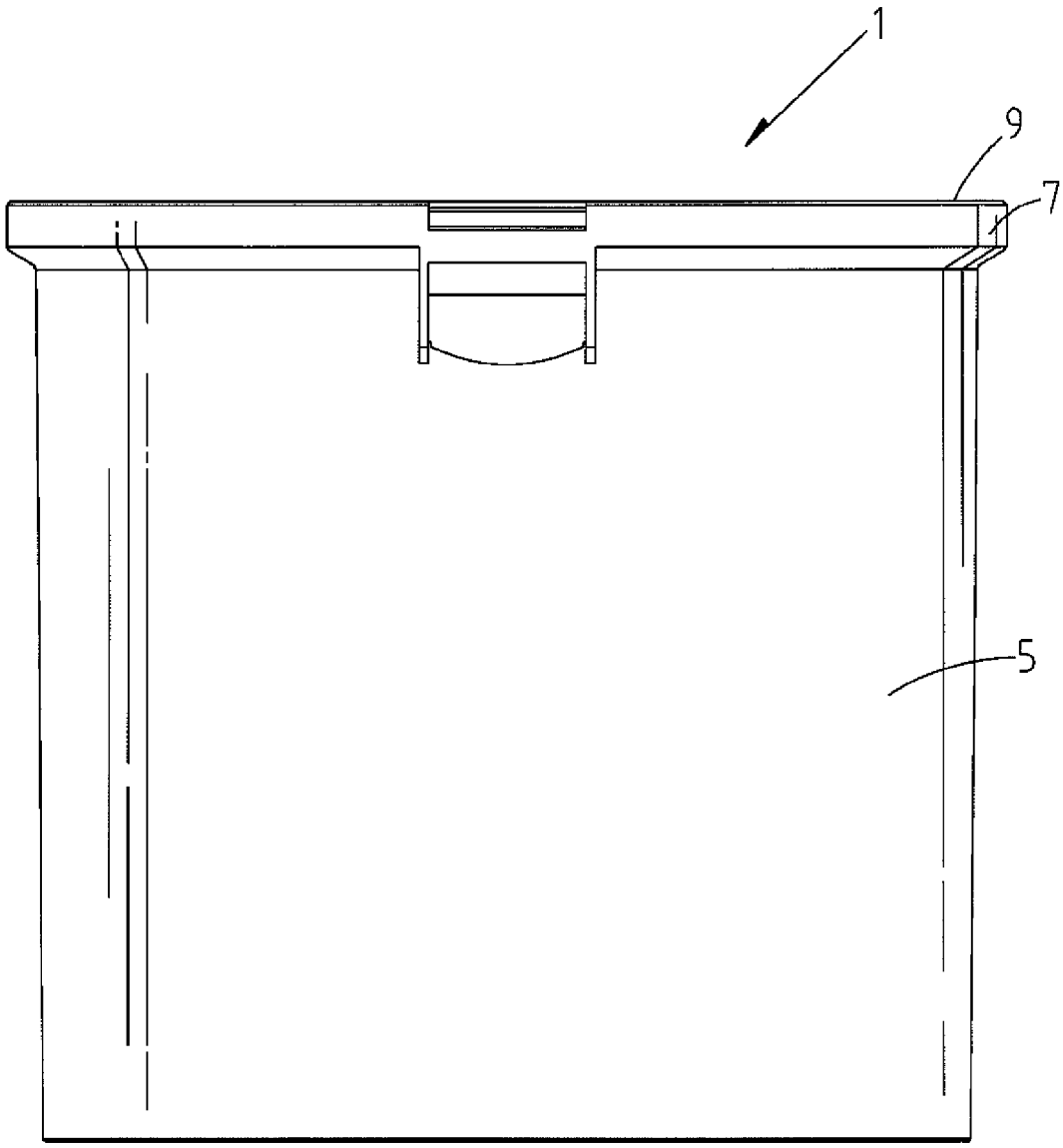
FIG. 9 is a side view of the container shown in FIG. 8.
Figure 10:
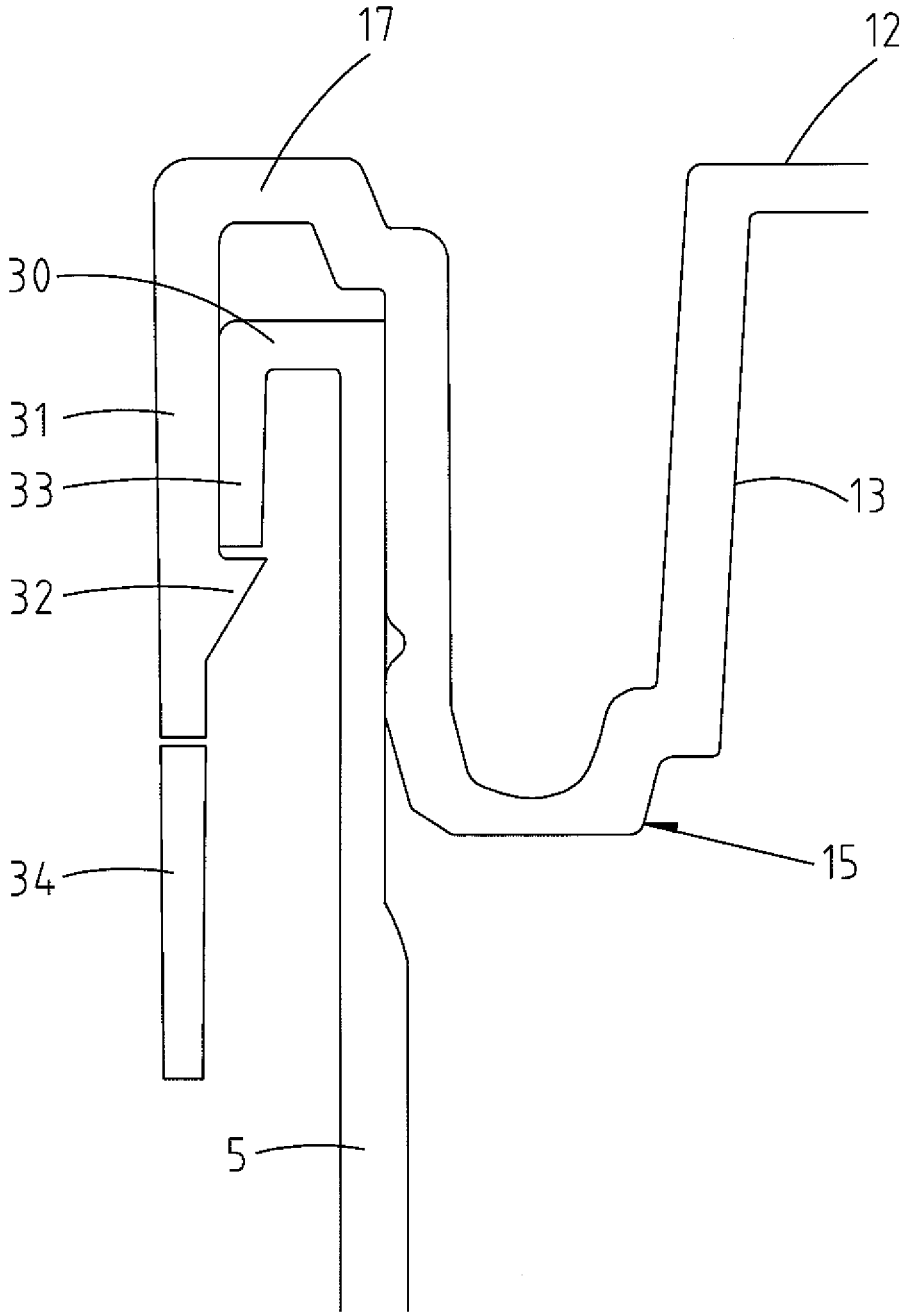
FIG. 10 is a detailed sectional view of a portion of the container and closure shown in FIG. 8.
Figure 11:
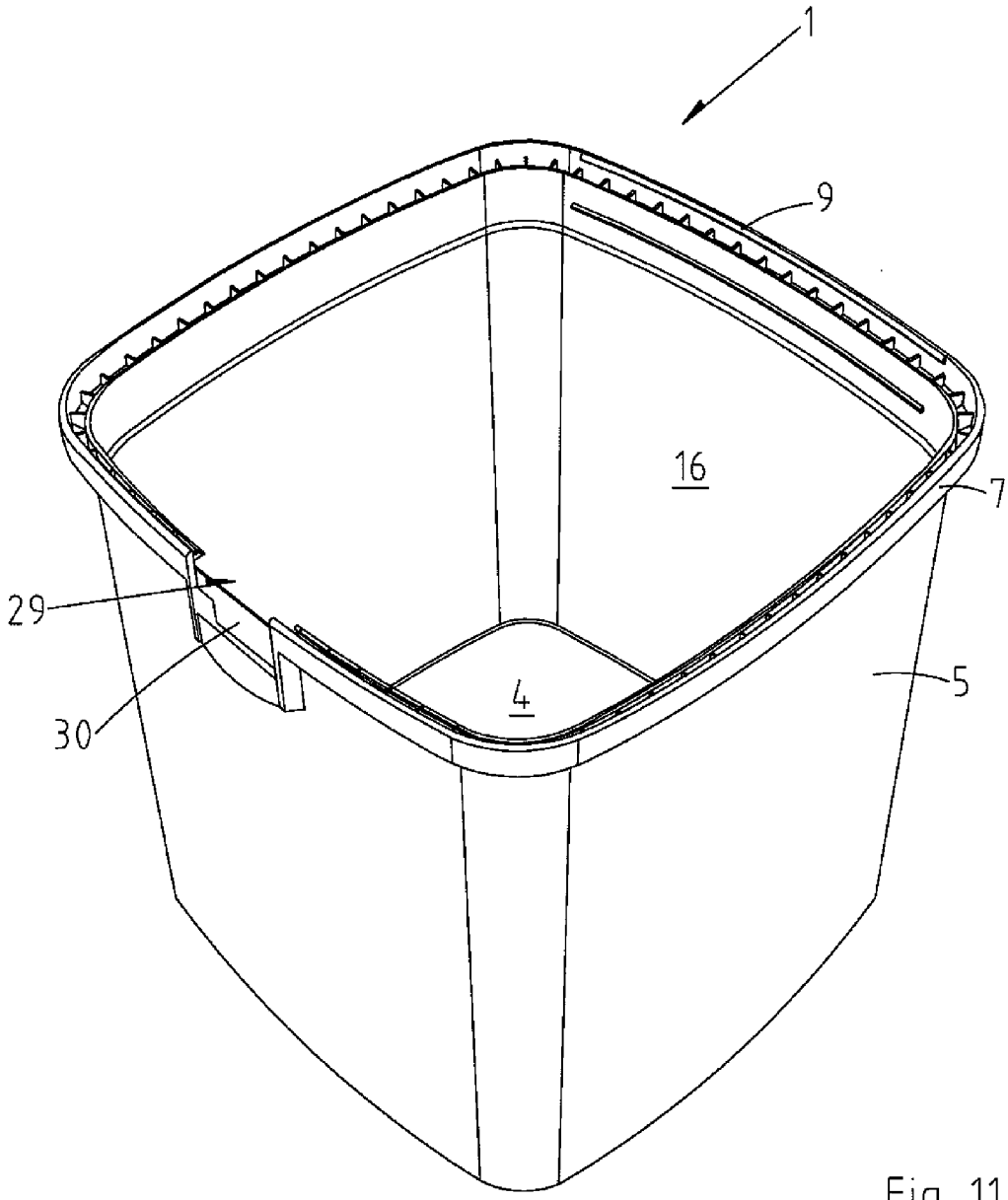
FIG. 11 is a perspective view of the container shown in FIG. 8 without the closure.
Figure 12:
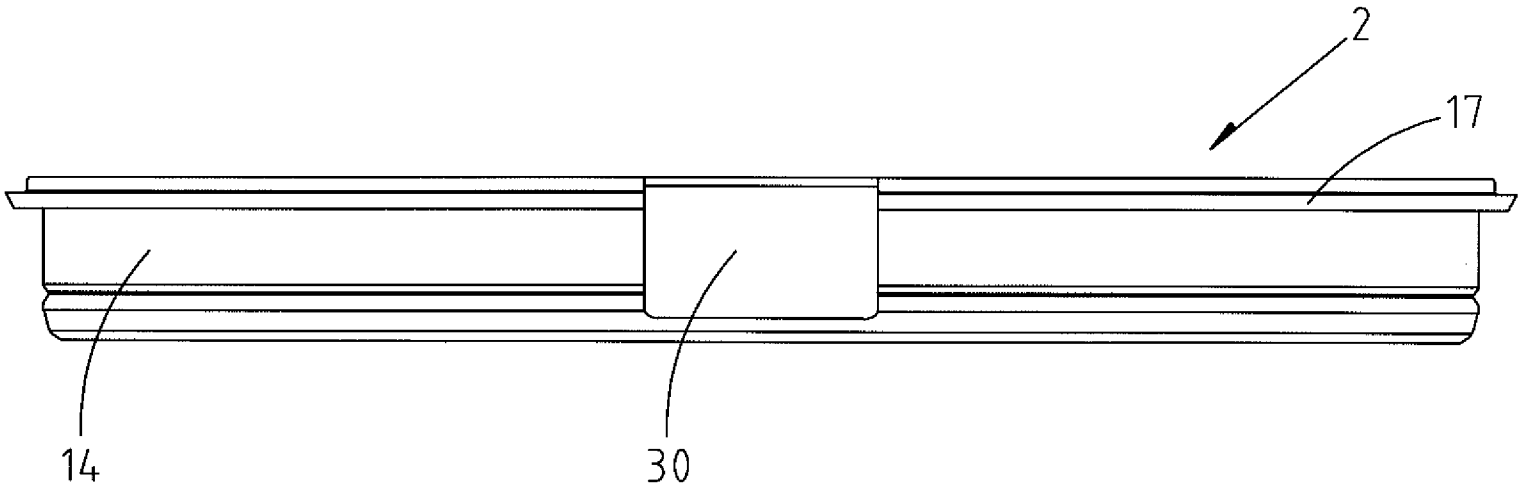
FIG. 12 is a side view of the closure shown in FIG. 8.
Figure 13:
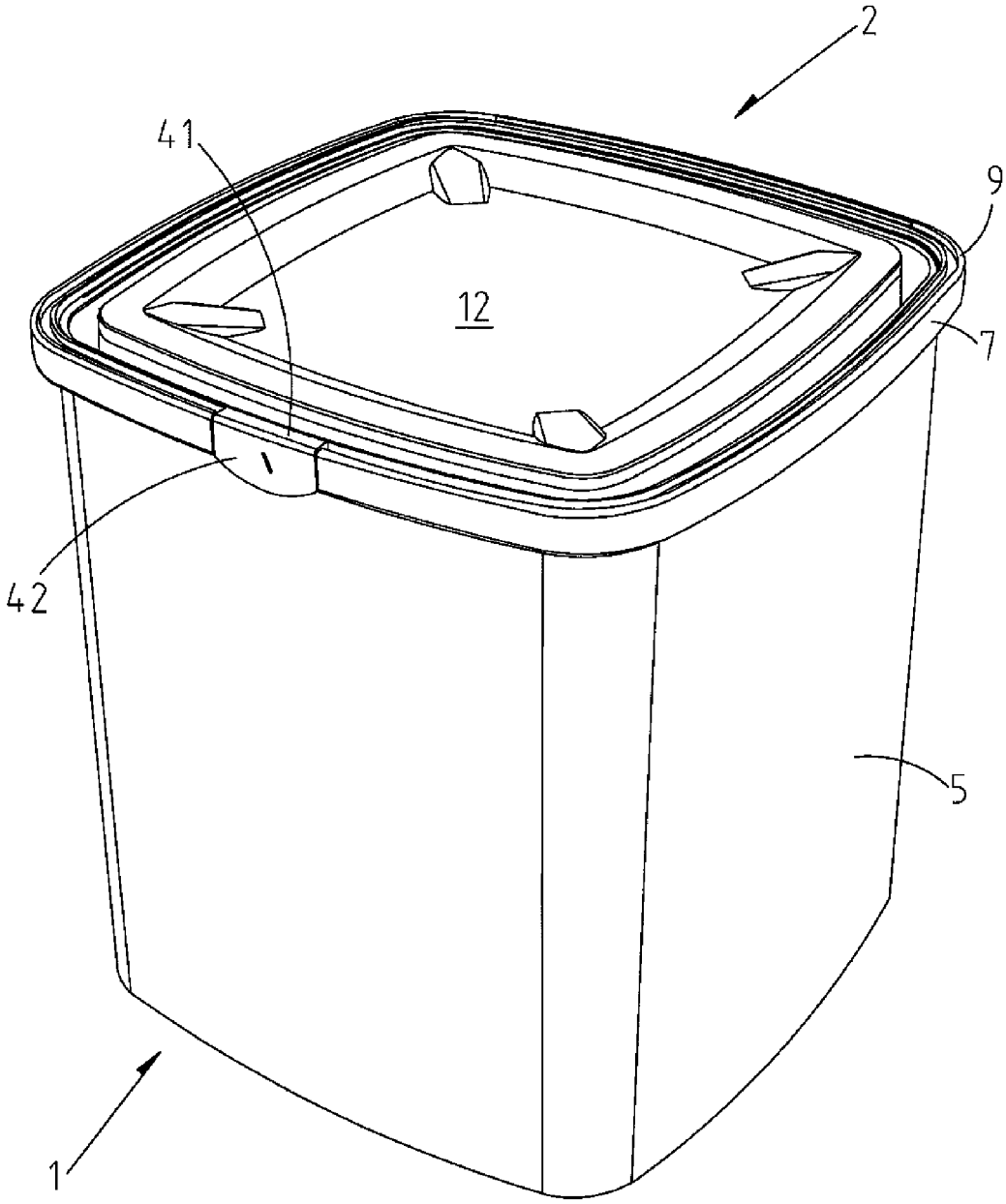
FIG. 13 is a perspective view of a container and a closure mounted on the container incorporating a closure actuating button according to a further alternative embodiment of the present invention.
Figure 14:
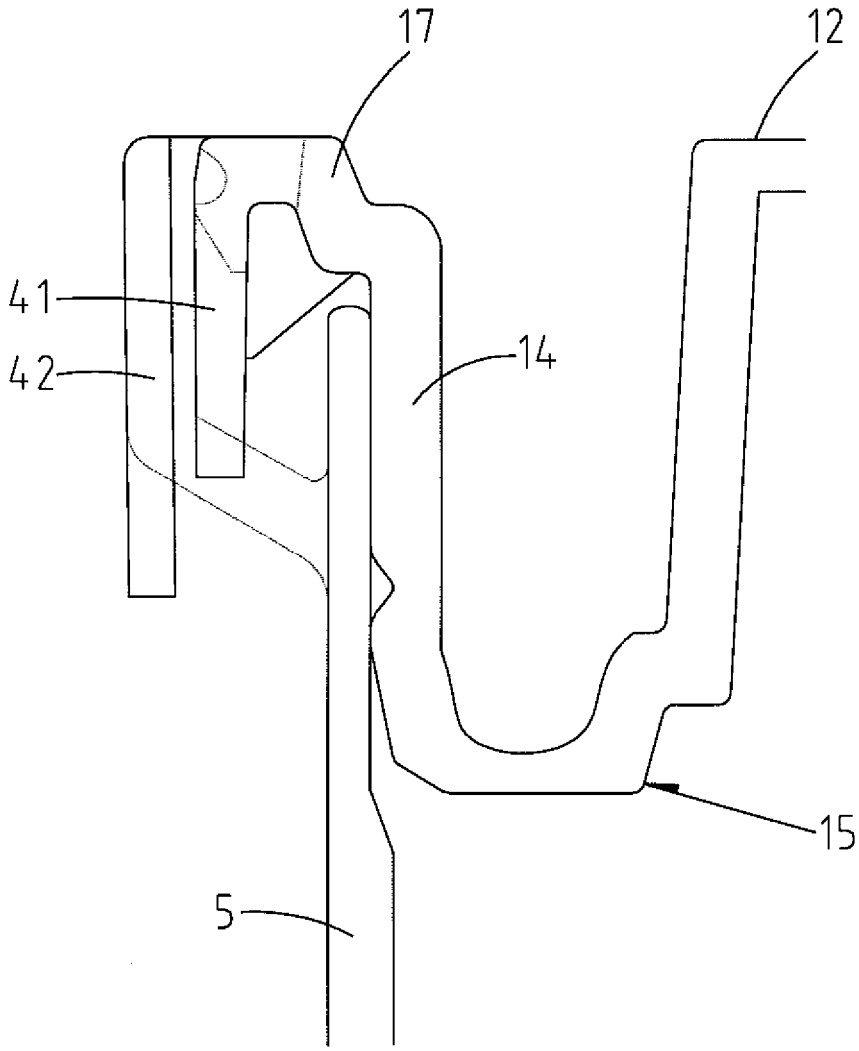
FIG. 14 is a detailed sectional view of a portion of the container and closure shown in FIG. 13.
Figure 15:
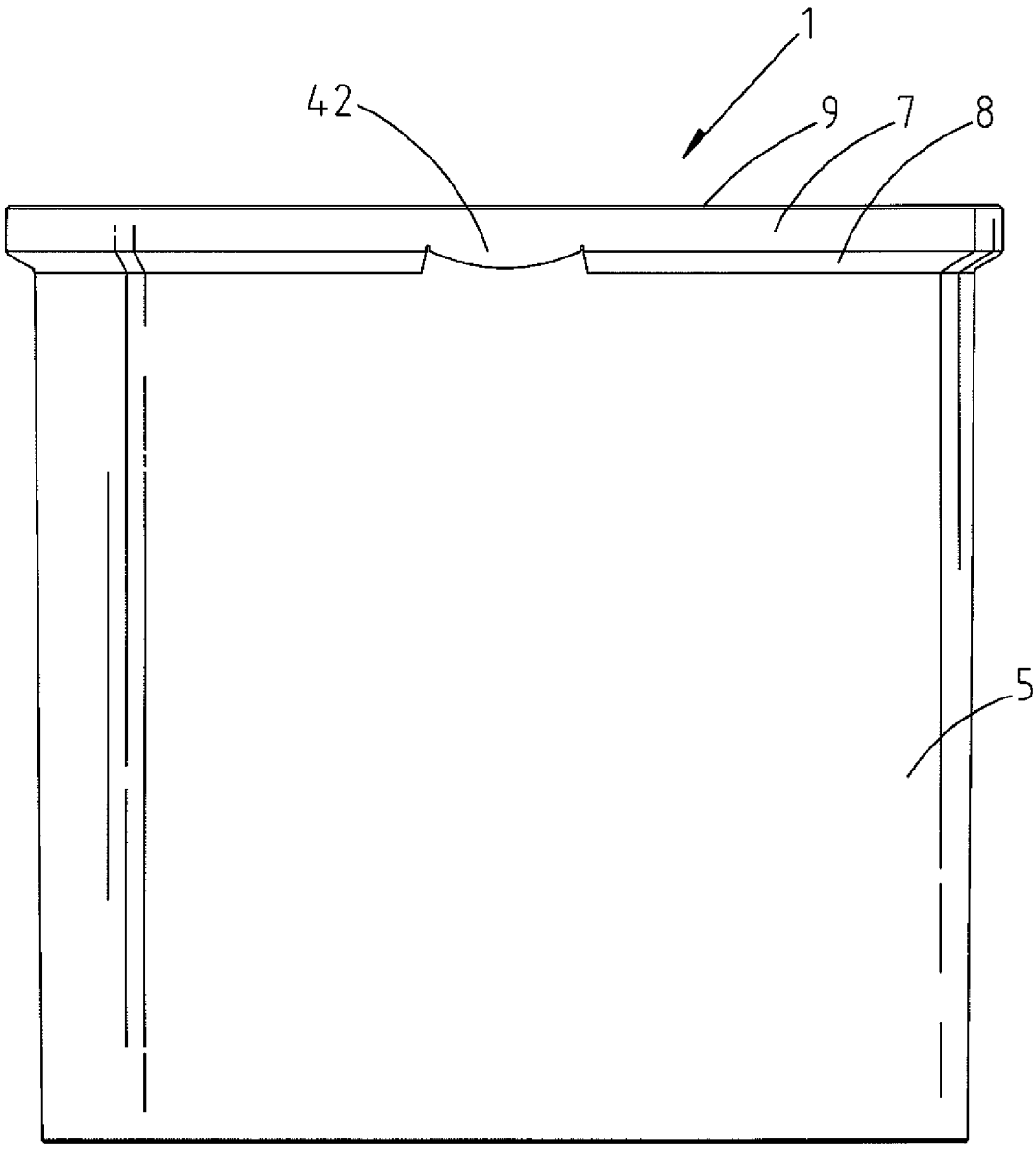
FIG. 15 is a side view of the container and closure shown in FIG. 13.
Figure 16:
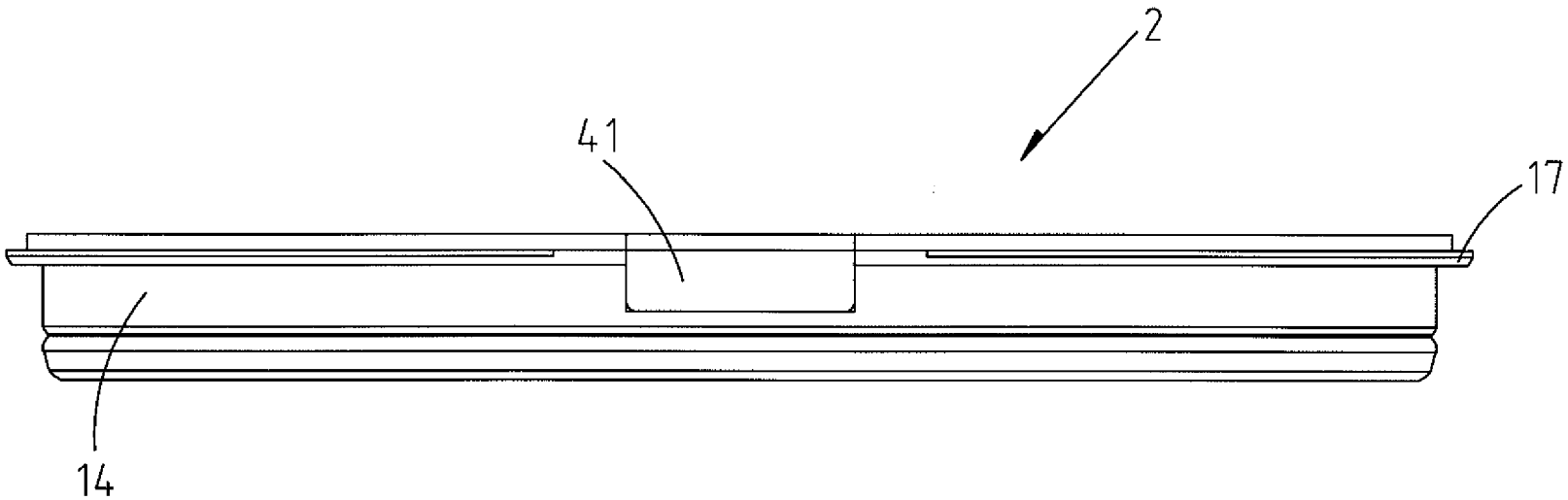
FIG. 16 is a side view of the closure shown in FIG. 13.
Figure 17:
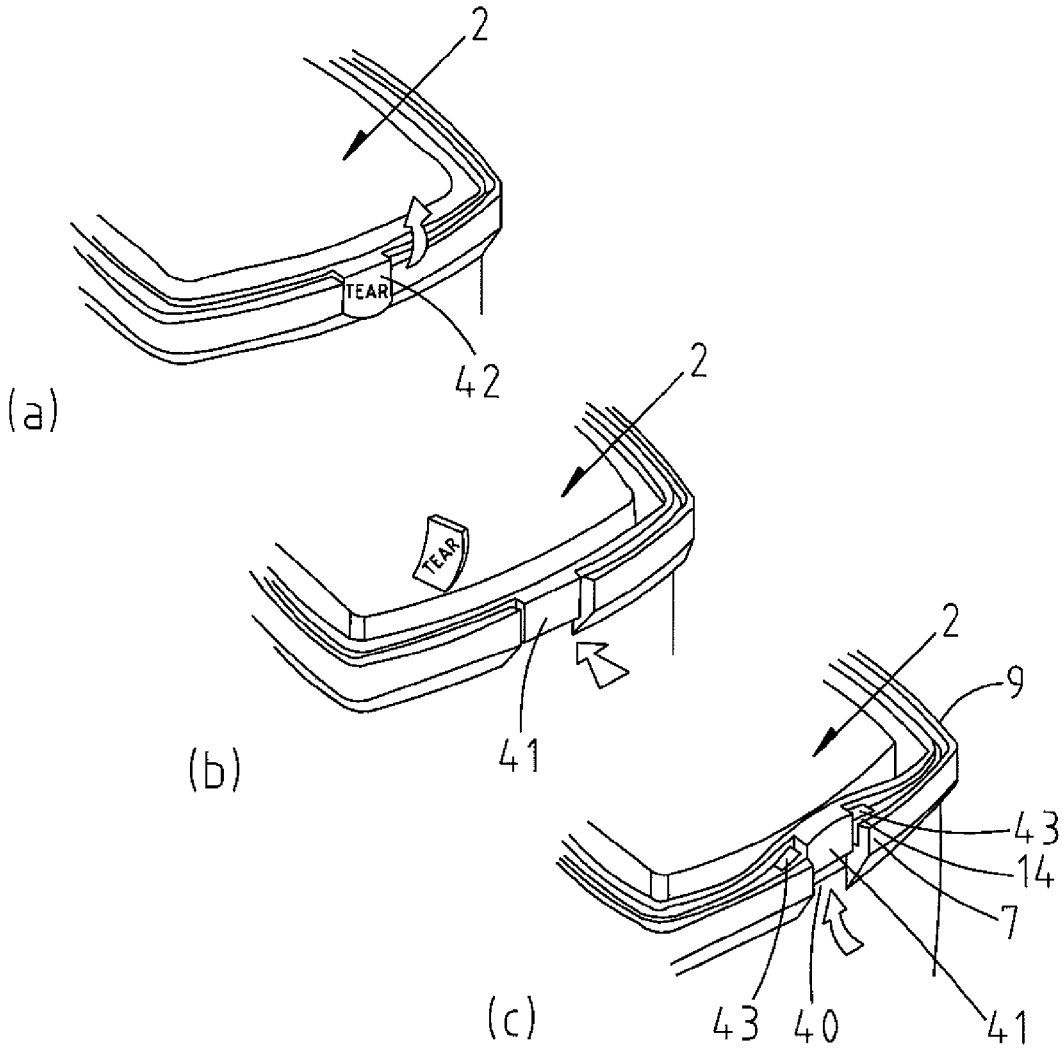
FIG. 17 are perspective views showing the steps involved when removing the closure from the container using the closure actuating button shown in FIG. 13.

The closure 2 comprises a top wall 12 and a skirt, indicated generally by the reference numeral 13, which extends downwardly from a peripheral edge of the top wall 12. The skirt comprises a closure wall 14 and biasing means, indicated generally by the reference numeral 15, for sealing the closure wall 14 against an interior wall surface 16 of the container side wall 5. Also shown is a closure flange 17 which projects from a free end of the closure wall 14 for snap engagement under the locking rib 9 when the closure 2 is inserted onto the container 1. The closures 2 are also extremely well suited to stacking as shown in FIG. 7, which makes them particularly suitable for use with 'pick and place' type gantry machinery. The vertical distance, indicated by the double ended arrow 'A', between the locking rib 9 and the top edge 6 of the container 1 is greater than the thickness, indicated by the double ended arrow 'B', of the free end of the closure flange 17 which locks under the locking rib 9. Also shown is at least one sealing rib 18, which is provided on the interior wall surface 16 of the container side wall 5 for engagement with a rib receiving channel 19 (see FIG. 7) formed in a facing surface of the closure wall 14. The closure flange 17 also comprises a plurality of through slots, a number of which are indicated by the reference numeral 20. A tamper evident seal, in the form of a thin plastic membrane 21 (see FIG. 4), extends across each slot 20.

In the embodiment shown the container 1 is cylindrical and the closure 2 is circular so that it fits onto the container 1. It should however be appreciated that the container may be any suitable shape as required or as desired. For example, the container may be a square shaped container, in which case the closure will also be square to provide a complimentary fit with the container.

In operation, the closure 2 is mounted on the container 1 by initially positioning the closure at the top edge 6 of container 1 and then applying a downward pushing force to the closure 2. As the closure 2 is being pushed onto the container 1 the biasing means 15 flexes so that the closure wall 14 pivots to the enable the closure 2 to slide into the container opening. The biasing means 15 then urges the closure wall 14 against the interior wall surface 16 of the container side wall 5. The action of the closure flange 17 against the locking rib causes the rim 7 to pivot so that the closure flange 17 engages against and then slides under the locking rib 9 so that the closure flange seats on or slightly above the top edge 6 of the container side wall 5. The biasing means 15 thus provides a resilient spring in the form of a flexible substantially U-shaped channel which forms a part of the skirt 13 of the closure 2. The biasing means 15 enables the closure wall 13 to seal against the interior wall surface 16 of the container 1 under a constant pressure to provide a good seal between the container 1 and closure 2 to securely and releasably retain the closure on the container 1. The sealing rib 18 on the interior wall surface 16 of the container side wall 5 engages in the rib receiving channel 19 formed in the closure wall 14. This ensures that the container 1 and the closure 2 are correctly aligned so that at least a portion of the top wall 12 of the closure 2 and the locking rib 9 are substantially diametrically level when the closure 2 is inserted on the container 1. The closure 2 is thus plug-like for insertion into the container opening so that when pressure is applied to the top wall 12 of the closure 2 it will effectively snap lock onto the container 1.

To remove the closure 2 from the container 1 an operative may initially insert the end of a tool, such as a screwdriver, into a slot 20 so that it engages under the closure flange 17. The operative then applies the required pressure to the tool to lift the closure flange 14 out from under the locking rib 9 to effectively release the closure 2 from the container 1. It will also be appreciated that inserting the end of a tool into one of the slots 20 will, at least for a first time, have the effect of breaking the thin plastic membrane 21 covering that slot 20. This will provide subsequent operatives with an indication that the container 1 has been opened previously.

With reference now to FIGS. 8 to 12, there is shown the container and closure configured in accordance with an alternative embodiment of the present invention. In the embodiment shown, the rim 7 and container flange 8 do not extend fully around the container side wall 5 and thereby define a cut-away portion, indicated generally by the reference numeral 29 (see FIG. 11), in the rim 7. In the region of the cut-away portion 29 there is provided a substantially hook shaped seating flange 30 which projects outwardly from a free end of the top edge of the container side wall 5.

Also shown is an actuating lever 31 which extends from a free end of the closure flange 17 in the region of the cut-away portion 29. The lever 31 includes a locking projection 32 which is formed on an inner surface thereof and engages under the terminal end 33 of the hook shaped seating flange 30 to releasably lock the closure 2 to the container 1.

To remove the closure from the container 1 an operative applies a pulling force to the actuating lever 31 to disengage the locking projection 32 from underneath the terminal end of the seating portion 30 to enable the closure 2 to be lifted and removed from the container 1. A removable tamper evident strip 34 is mounted to the container 1 substantially adjacent the hook shaped seating portion 30 and proximal to a free end of the actuating lever 31. The presence of the tamper evident strip 34 prevents an operative actuating the lever 31 by preventing access to the lever 31. The tamper evident strip 34 must thus be removed before an operative may actuate the lever 31. In the instance shown the container 1 is substantially square shaped.

FIGS. 13 to 17 show an alternative arrangement, in which the container rim 7 and container flange 8 again do not extend fully around the container side wall 5, but define a receiving notch, indicated generally by the reference numeral 40 (see FIG. 17*c*), for a closure actuating button 41 which is formed on the closure wall 14. A tamper evident strip 42 extends across the closure actuating button 41. In this embodiment, a locking flange 43 projects from the closure wall 14 on each side of the of the closure actuating button 41 and each locking flange 43 engages under the locking rib 9 on the container rim 7. By applying a pressing force to the closure actuating button 41 an operative pushes the locking flanges 43 away from under the locking rib 7 formed on the container and enables the closure 2 to be removed from the container 1.

The embodiments shown in FIGS. 9 to 17 thus show two alternative constructions for enabling operatives to avoid having to use the end of a tool to pry open a container. In particular, the embodiment shown in FIGS. 9 to 12 provides a lever which is able pulled by an operative to facilitate the removal of the closure from the container, and FIGS. 13 to 17 alternatively show the use of a closure actuation button which is pushed to thereby disengage locking flanges from underneath the locking rib on the container enable the closure to be lifted and removed from the container.

Aspects of the present invention have been described by way of example only and it should be appreciate that additions and/or modifications may be made thereto without departing from the scope thereof as defined in the appended claims.

The invention claimed is:

1. A container comprising:

a container body having a base and a side wall with a top edge defining a container opening opposite the base, a rim spaced apart from the side wall by a container flange, the container flange extends from below the top edge of the container outwardly of the container body from an exterior wall surface of the container side wall, and the rim projects from the container flange and extends above the top edge of the container side wall, in which the rim and container flange extend around an exterior wall surface of the container to define, with a portion of an exterior wall surface of the container side wall, a substantially U-shaped channel at the top edge of the container side wall, a locking rib which extends around the perimeter of the rim and projects from a free end of the rim above the top edge of the container side wall, and a closure for mounting on the container body, the closure having a top wall and a skirt which extends downwardly from a peripheral edge of the top wall, the skirt including a closure wall and a biasing element for sealing the closure wall against an interior wall surface of the container side wall, and a closure flange which projects from a free end of the closure wall for snap engagement under the locking rib and above the U-shaped channel when the closure is inserted into the container opening, in which the distance between the locking rib and the top edge of the container is greater than a thickness of the free end of the closure flange which locks under the locking rib, and in which at least one sealing rib is provided for engagement with a rib receiving channel, the sealing rib and rib receiving channel are located so that, when engaged, align and center the closure on the container when the closure is mounted on the container.

2. The container as claimed in claim 1, in which the at least one sealing rib is provided on an interior wall surface of the container side wall and the rib receiving channel is formed in a facing surface of the closure wall.

3. The container as claimed in claim 1, in which the container is an integrally formed container.

4. The container as claimed in claim 1, in which when the closure is inserted onto the container the rim pivots so that the closure flange engages against and slides under the locking rib to enable the closure flange to seat on or slightly above the top edge of the container side wall and under the locking rib.

5. The container as claimed in claim 1, in which the closure forms a plug for insertion into the container opening.

6. The container as claimed in claim 1, in which the closure flange comprises a plurality of through slots.

7. The container as claimed in claim 6, in which a tamper evident seal in the form of a thin plastic membrane extends across each slot.

8. The container as claimed in claim 1, in which a portion of the top wall of the closure and the locking rib are substantially diametrically level when the closure is mounted on the container.

9. The container as claimed in claim 1, in which the rim and container flange do not extend fully around the container side wall to define a cut-away portion in the rim.

10. The container as claimed in claim 9, in which a substantially hook shaped external seating flange projects from a free end of the top edge of the container side wall in the region of the cut-away portion.

11. The container as claimed in claim 10, in which an actuating lever having a locking projection formed on an inner surface thereof depends from a free end of the closure flange.

12. The container as claimed in claim 9, in which an actuating lever having a locking projection formed on an inner surface thereof depends from a free end of the closure flange.

13. The container as claimed in claim 12, in which the locking projection engages under a terminal end of the hook shaped seating flange to releaseably lock the closure to the container.

14. The container as claimed in claim 13, in which the closure is removed from the container by disengaging the locking projection from underneath the terminal end of the seating flange.

15. The container as claimed in claim 12, in which the closure is removed from the container by disengaging the locking projection from underneath the terminal end of the seating flange.

16. The container as claimed in claim 9, in which a removable tamper evident strip is mounted to the container substantially adjacent the hook shaped seating flange and proximal to a free end of the actuating lever.

17. The container as claimed in claim 9, in which the container and closure are substantially square shaped.

18. The container as claimed in claim 1, in which the rim and container flange do not extend fully around the container side wall to define a receiving notch for a closure actuating button formed on the closure wall.

19. The container as claimed in claim 18, in which a tamper evident strip extends across the closure actuating button.

20. The container as claimed in claim 19, in which a locking flange projects from the closure wall on each side of the closure actuating button, each locking flange engaging under the locking rib when the closure is mounted on the container.

21. The container as claimed in claim 18, in which a locking flange projects from the closure wall on each side of the closure actuating button, each locking flange engaging under the locking rib when the closure is mounted on the container.

* * * * *